US006398036B1

(12) United States Patent
Griebat et al.

(10) Patent No.: US 6,398,036 B1
(45) Date of Patent: Jun. 4, 2002

(54) CORN MILLING AND SEPARATING DEVICE AND METHOD

(75) Inventors: John Griebat, Cedar Rapids, IA (US); Alan Koechner, Crystal Lake, IL (US)

(73) Assignee: The Quaker Oats Company, Chicago, IL (US)

( * ) Notice: Subject to any disclaimer, the term of this patent is extended or adjusted under 35 U.S.C. 154(b) by 0 days.

(21) Appl. No.: 09/802,180

(22) Filed: Mar. 8, 2001

Related U.S. Application Data

(62) Division of application No. 09/377,083, filed on Aug. 19, 1999.

(51) Int. Cl.[7] ..... B07B 13/00; B03B 4/00

(52) U.S. Cl. ..... 209/480; 209/479; 209/467; 209/684; 209/691

(58) Field of Search ..... 209/684, 479, 209/480, 481, 691, 695, 694, 467

(56) References Cited

U.S. PATENT DOCUMENTS

| | | | | |
|---|---|---|---|---|
| 910,992 A | * | 1/1909 | Curtis | 209/422 |
| 1,390,806 A | * | 9/1921 | Miller | 209/684 |
| 1,879,385 A | * | 9/1932 | Mayhew | 209/684 |
| 3,734,752 A | | 5/1973 | Headley | |
| 4,207,118 A | | 6/1980 | Bonnyay et al. | |
| 4,716,218 A | | 12/1987 | Chen et al. | |
| 4,978,443 A | * | 12/1990 | Cashman et al. | 209/684 |
| 5,198,035 A | | 3/1993 | Lee et al. | |
| 5,271,570 A | | 12/1993 | Satake et al. | |
| 5,295,629 A | | 3/1994 | Satake et al. | |
| 5,390,589 A | | 2/1995 | Satake et al. | |
| 5,394,792 A | | 3/1995 | Satake et al. | |
| 5,395,059 A | | 3/1995 | Satake et al. | |
| 5,413,034 A | | 5/1995 | Satake et al. | |
| 5,419,252 A | | 5/1995 | Satake | |
| 5,511,469 A | | 4/1996 | Satake et al. | |
| 5,678,477 A | | 10/1997 | Satake et al. | |
| 5,713,526 A | | 2/1998 | Martin et al. | |
| 5,752,664 A | | 5/1998 | Satake et al. | |
| 5,773,066 A | | 6/1998 | Satake et al. | |
| 5,820,039 A | | 10/1998 | Martin et al. | |
| 5,846,591 A | | 12/1998 | Satake et al. | |
| 5,852,882 A | | 12/1998 | Kendall et al. | |
| 5,860,531 A | | 1/1999 | Satoru et al. | |

* cited by examiner

*Primary Examiner*—Tuan N. Nguyen
*Assistant Examiner*—Joseph Rodriguez
(74) *Attorney, Agent, or Firm*—Ryndak & Suri

(57) ABSTRACT

A table separator is provided, wherein the table separator comprises a plurality of solid-bottom trays and a plurality of dimples for facilitating separation of degerminated corn into endosperm and germ fractions, the dimples being aligned in linear juxtaposition on the surface of the trays and having a center portion raised with respect to the perimeter of the dimples.

17 Claims, 4 Drawing Sheets

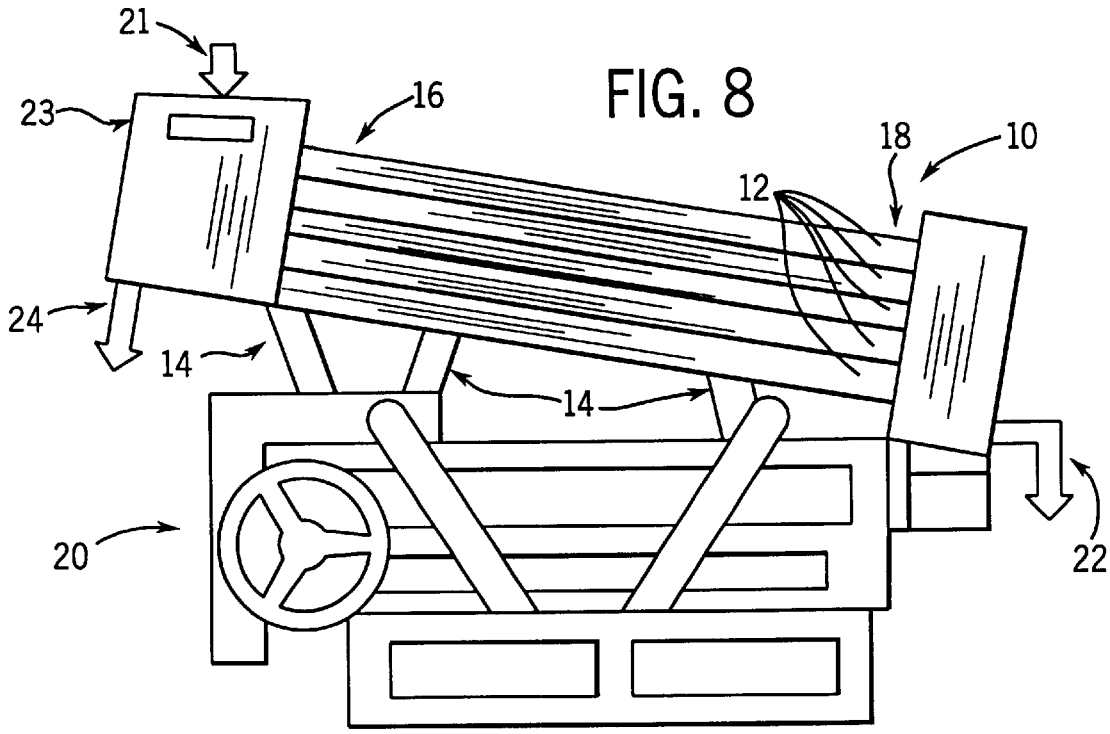
FIG. 8
FIG. 9
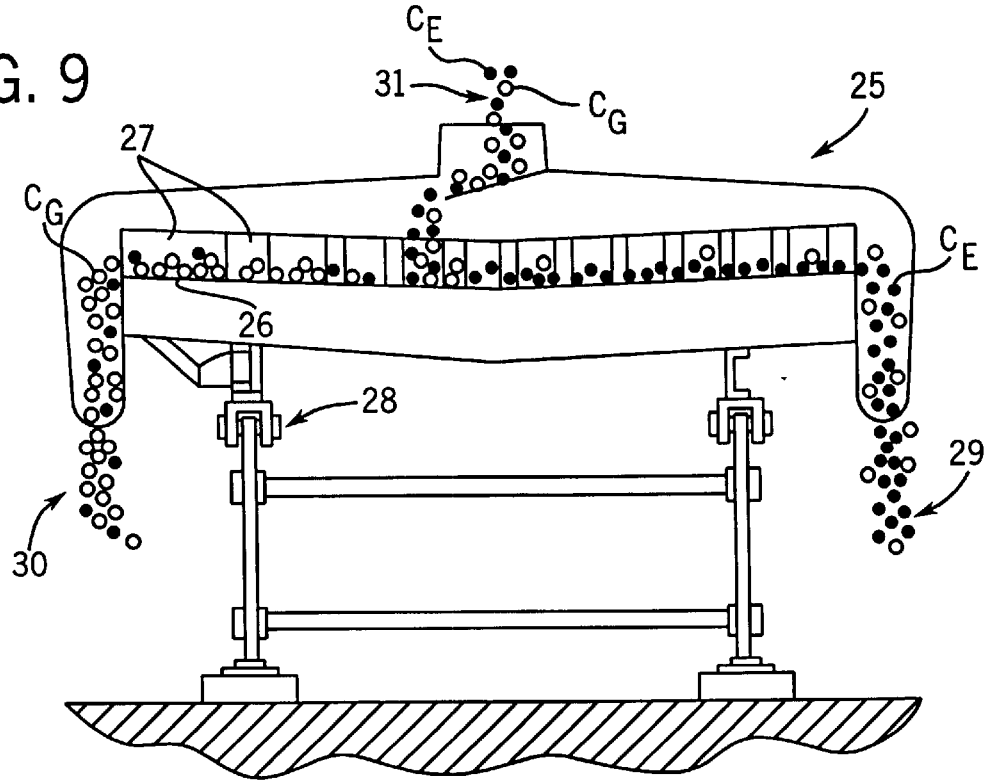

CORN MILLING AND SEPARATING DEVICE AND METHOD

CROSS REFERENCE TO RELATED APPLICATIONS

This is a divisional of U.S. patent application Ser. No. 09/377,083, filed Aug. 19, 1999.

FIELD OF THE INVENTION

The invention relates to methods of corn milling and efficiently separating degerminated corn into endosperm and germ fraction output streams. More particularly, the present invention relates to a method of separating degerminated corn using a table separator where the degerminated corn comprises endosperm and germ and has had the hull substantially removed, the degerminated corn being separated on the basis of density into at least two output streams comprising at least one endosperm-rich fraction output stream and at least one germ-rich fraction output stream. The invention also, more particularly, relates to a method of milling corn that incorporates the aforementioned, inventive separation process.

The present invention also relates to a table separator used in the separation process in both inventive methods. More particularly, the invention relates to a table separator suitable for separating degerminated corn into at least one endosperm (grit) fraction output stream having a relatively high concentration of endosperm and at least one germ fraction having a relatively high concentration of germ, wherein the solid surface of oscillating trays used in the table separator have a plurality of surface dimples or indentations of a specified depth and shape in a linear array for facilitating the separation process.

BACKGROUND OF THE INVENTION

Generally, corn milling processes for the production of grits and other corn products separate the endosperm from the germ and the hull. In white corn used for grit production, the endosperm typically accounts for approximately 80–85.5 on a weight basis of the corn kernel whereas the germ and the hull respectively account for approximately 10–14% and 5–6%. The germ is substantially high in fat, typically containing approximately from 31.1% to 35.1% fat on a dry weight basis. Production of various types of corn products requires that the grit be separated from the germ. The germ is useful for recovery of corn oil because of its relatively high fat content. In addition, even a relatively small amount of fat remaining in the grit can cause such grit to become rancid, impart a mealy texture to a cooked grit product or impart other undesirable qualities to foods containing such product.

Conventionally, after corn has been degerminated (i.e., fractured into pieces of endosperm (grit) and germ), the endosperm is separated from the germ by means of vacuum gravity separators, also termed "gravity tables." Gravity tables include, for example, pneumatic concentrators. These devices have a porous table surface on which the material to be separated is fed. As air is forced through the pores, it fluidizes the material, causing the particles of the material to move across the table surface based on density, size, and shape. Changes in slope of the table can be used to further improve the degree of particle separation. These systems, however, take up considerable space in the production facility and are not only relatively costly to purchase but also relatively expensive to operate as they require large volumes of air, in the range of about 4,000–5,000 CFM to process about 83 pounds of corn per minute. Further, during the course of the separation process, vacuum gravity systems require substantial dust collection and handling equipment, adding further to the capital and operating cost of such systems.

Consequently, there exists a need for a less expensive and more efficient system and method for separating the endosperm from the germ which requires less space in the processing facility. There also exists a need for a method of corn processing that incorporates the aforementioned method of separating the endosperm from the germ.

SUMMARY OF THE INVENTION

In accordance with one aspect of the present invention, a corn milling system and method is provided for efficiently separating degerminated corn into endosperm and germ fractions on the basis of density by use of a table separator. It was discovered unexpectedly that table separators, typically used for separating objects of regular and/or uniform shape such as rice grains, could be effectively used in a process for separating degerminated corn, which degerminated corn consists of relatively randomly and irregularly shaped pieces of corn endosperm and germ after fracturing in a degerminator. The method involves (a) supplying a feed stream of degerminated corn to the table separator and (b) separating the degerminated corn so as to form at least two output streams comprising at least one endosperm fraction output stream having a predominant concentration of endosperm (grit) and at least one germ fraction output stream having a predominant concentration of germ. Preferably, the table separator is operated so that the output stream containing primarily endosperm fraction typically has, on a weight basis, a minimum concentration of 90% endosperm with the balance being corn germ, and the output stream containing primarily corn germ fraction typically has a minimum concentration of 90% corn germ with the balance being endosperm. Generally, in commercial production, steps (a) and (b) will occur continuously, although the method may be practiced on a batch basis.

As used herein, the term "table separators" refers to a separator having a solid table or solid tray-like surface on which separation of corn endosperm and germ is achieved by feeding the corn endosperm and germ onto the table or tray-like surface and oscillating or reciprocating the surface to effect a separation of endosperm and germ based on density differences. There are two principal types of table separators: oscillating tray separators and compartment separators. In both types, the degerminated corn is fed onto a solid table or tray-like surface that is subjected to oscillating or reciprocating movement which causes the degerminated corn to separate into fractions of endosperm and germ.

As used herein, the term "degerminated corn" refers to corn kernels that have been fractured to release their constituents, comprising endosperm, germ, and hull. Usually, the hull component is substantially removed before separation of the endosperm and germ components by any suitable means known to those skilled in the art, such as an aspirator, for example.

In accordance with another aspect of the present invention, a corn milling process is provided which incorporates the foregoing method for separating the endosperm from the germ. The corn milling process comprises degerminating (fracturing) the corn kernels into germ and endosperm pieces or particles, and thereafter separating the endosperm particles from the germ particles with a table separator to form at least one endosperm fraction output stream having a relatively high concentration of endosperm and at least one germ fraction output stream having a relatively high concentration of corn germ.

In accordance with another aspect of the invention, a table separator is provided that is particularly useful for practicing the foregoing disclosed methods of corn milling and separating degerminated corn. The table separator has at least one, and may have a plurality of, solid-bottomed trays, positioned so that one side is inclined with respect to the opposite side. The tray or trays oscillate directionally upward and toward the top of the incline, which movement causes an input stream of degerminated corn fed to the table separator to separate into output streams of endosperm and germ fractions.

Each tray has a dimpled or indented tray surface in which the surface of the trays has a plurality of dimples or indentations which facilitate the separation of degerminated corn into fractions on the basis of density. Each dimple is a depression in the tray surface having a depth and a cross-sectional shape and dimension, defined by the dimple perimeter. Preferably, all of the dimples in the tray are of a similar size and shape. Preferably, the dimples have one straight end, a curved end opposite from the straight end; parallel or generally parallel sides; a length typically of about 10–14 millimeters, preferably 11 millimeters; a width of about 5–8 millimeters, preferably 6 millimeters; and a depth that increases from about zero (0) millimeters at the curved end to a maximum working depth in the range of about 1.5 millimeters to about 6.0 millimeters at the straight end, relative to the undimpled portion of the tray surface. The dimples have a side-to-side spacing of about 2 to 4 millimeters and an end-to-end spacing of about 2 to 4 millimeters. Usually, adjacent rows are staggered in the lengthwise direction. Alternatively, the dimples or indentations may be of virtually any shape; for example, round, square, octagonal, or triangular.

Both inventive methods of corn milling and of separating degerminated corn offer numerous commercial advantages over conventional milling techniques, including a higher capacity throughput, a higher degree of separation, a lower operating cost because of reduced requirements for process air, and substantially lower capital equipment costs. Moreover, both inventive methods utilize table separators that take up less space in the production facility and are relatively dust-free in their operation. In addition, the dimpled configuration of the inventive table separator facilitates a higher degree of separation of degerminated corn.

BRIEF DESCRIPTION OF THE DRAWINGS

Other advantages and features of the invention will become apparent from the following description and from reference to the drawings.

FIG. 8 is a schematic diagram of an oscillating tray-type separator; and

FIG. 9 is a schematic diagram of a compartment-type separator.

DETAILED DESCRIPTION OF THE INVENTION

This invention includes all alternatives, modifications, and equivalents that may be encompassed within the spirit and scope of the invention, as defined by the appended claims. The invention is not limited to the embodiments described herein. Throughout the following description, like numerals refer to like parts or steps.

Figure 6:
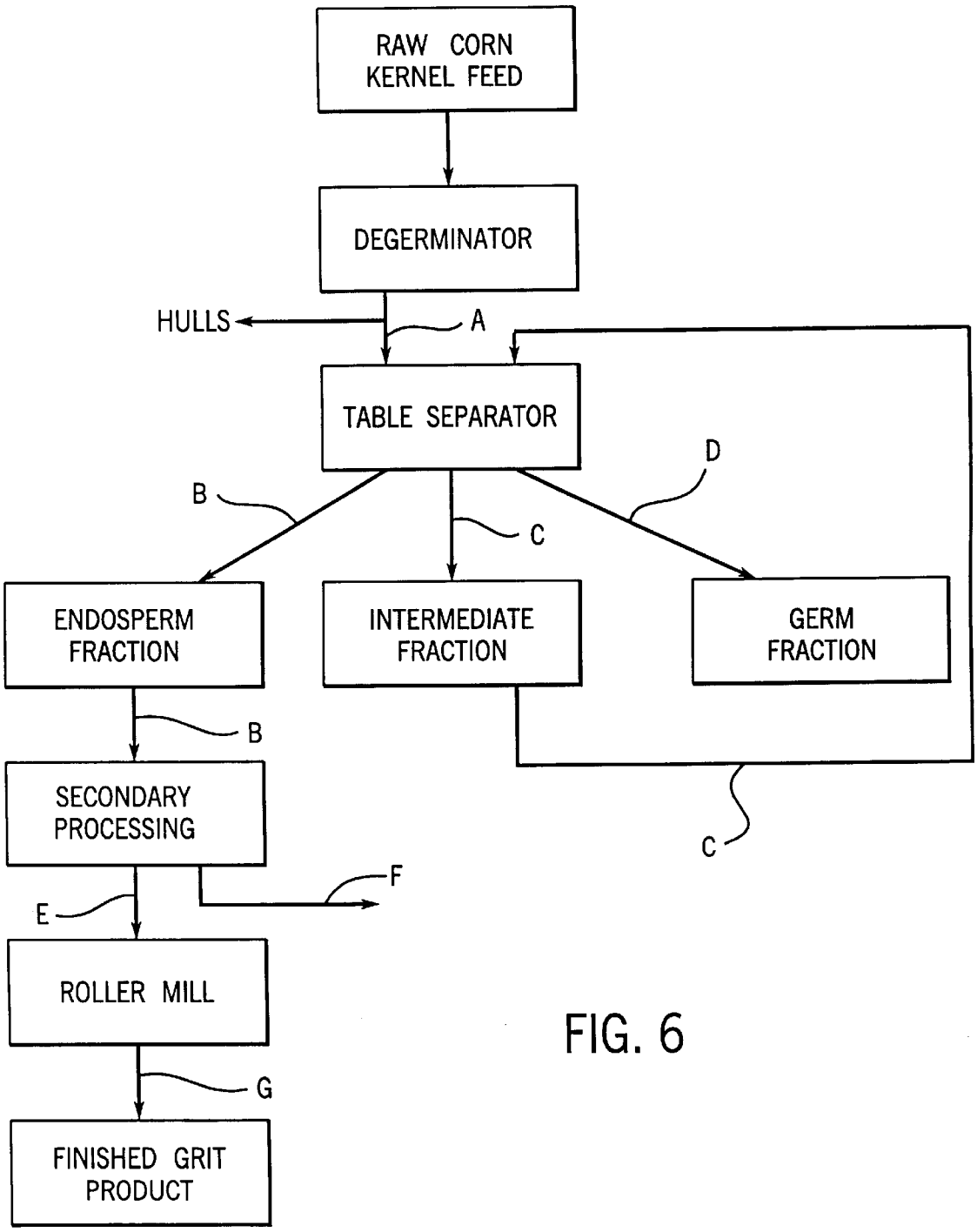
FIG. 6 is a schematic flow diagram of a corn milling system and method using a table separator to separate degerminated corn in accordance with the invention.
Figure 7:
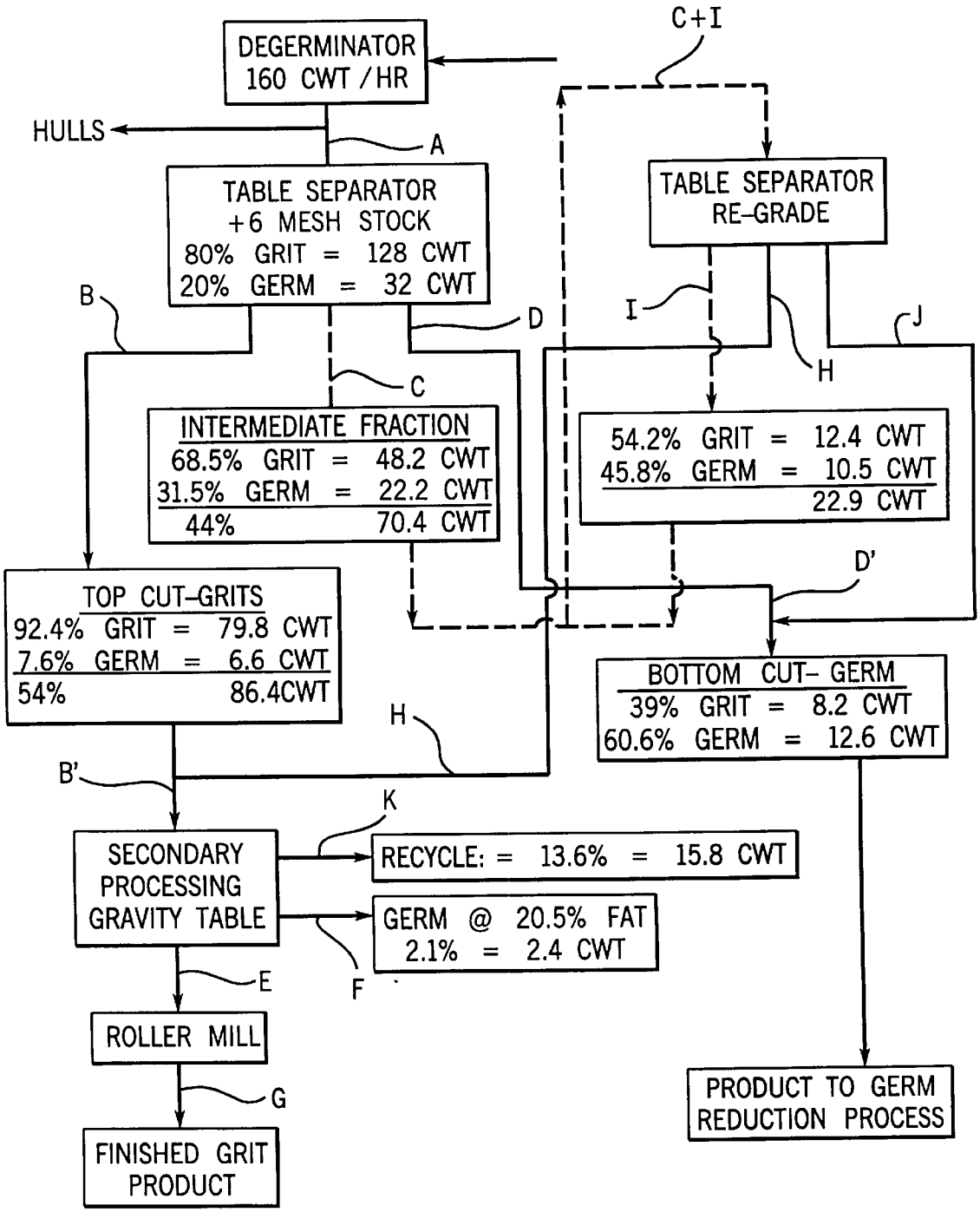
FIG. 7 is a schematic flow diagram of another system and method of corn milling that uses a table separator to separate degerminated corn in accordance with the invention.

Referring initially to FIGS. 6–7, a flow chart is illustrated of the steps involved in a method of milling corn in accordance with the present invention so as to efficiently produce a fraction having a relatively high concentration of endosperm that is suitable for use in the production of corn grits and a fraction having a relatively high concentration of germ.

The process begins with supplying a continuous feed stream of corn kernels to a degerminator. Degerminators are well known to those skilled in the art, and therefore a detailed disclosure of such equipment is not provided. Many types of degerminators may be used, such as degerminators from the Ocrim Corp. and Beall Corp., for example. The degerminator fractures the corn kernels into their constituents—endosperm (also known as grit), germ, and hull (also known as bran). The hull is substantially removed such as with a pneumatic cleaner or aspirator, for example.

Typically, the degerminated corn (mixture of endosperm and germ) ranges in particle sizes of up to about 20 mesh or greater. The degerminated corn can be readily sized or separated on the basis of particle size, such as by a gyrating sifter device. Typically, in accordance with the invention, the particle size utilized in the method of the present invention is of the size within the range of from about 3.5 to about 6.5 mesh and more typically about 4.5 to about 6.5 mesh. "Mesh" as used herein means the number of openings per linear inch in a wire screen or synthetic cloth, for example. The mesh size range may also be equivalently stated as −3.5, +6.5, meaning that the particles are smaller in size than 3.5 mesh and greater in size than 6.5 mesh. Typically, the wire used on a 3.5 mesh screen has a diameter of approximately 0.054 inches and the wires used on 4.5, 6, and 6.5 mesh screens generally have diameters of approximately 0.041, 0.035, and 0.032 inches, respectively. The fraction of degerminated corn within the desired size range (e.g., 3.5 to 6.5 mesh or 4.5 to 6.5 mesh, for example) forms degerminated feed streams for subsequent processing in accordance with the invention and is set forth as feed or inlet stream A in FIG. 6.

Typically, on a weight basis, the −4.5, +6 mesh fraction of the degerminated corn, after having the hull flowing fines substantially removed, contains endosperm at a weight concentration of about 80% and germ at a concentration of about 20%. For degerminated corn in a particle size range of −4.5, +6 mesh, the endosperm has a density of about 40 pounds per $ft^3$, and the germ has a density of about 31 pounds per $ft^3$.

As shown in FIG. 6, stream A of degerminated corn is fed onto a solid surface in a table separator, which can be either an oscillating tray separator or a compartment-type separator, for example, although the oscillating tray separator is preferred. Such devices are available commercially and consequently are not described in detail herein. Both types of separators operate on the principle wherein the motion and the slope of the table surface cause the particles to separate so that lighter-density particles move to a position above the heavier material and are discharged from the lower-angled side of the table. The heavier-weight particles are discharged from the higher-angled side of the table surface.

As shown schematically in FIG. 8, an oscillating tray separator 10 comprises a plurality (five) of solid-bottomed trays 12, in stacked relation, for contacting and effecting separation of the degerminated corn into fractions comprising primarily endosperm and germ fractions. The trays are mounted for oscillating movement and positioned so that one end 16 is inclined with respect to the opposite end 18. The trays are oscillated by a drive mechanism 20 which is connected to trays 12 by mounting structure 14. As the trays oscillate directionally upward and toward the top of the incline 16, the movement causes the degerminated corn, fed through inlet stream 21 to separator inlet 23, to separate on the basis of density into fractions so as to form (a) at least one output stream 22 comprising a relatively high concentration of endosperm and (b) at least one output stream 24 comprising a relatively high concentration of germ. One example of an oscillating tray separator, sometimes referred to as a paddy separator, Model PS400, is manufactured by Satake Engineering Co., Ltd. The PS400 oscillating tray separator requires about 200–300 CFM of process air to operate, which is about 4% to 7.5% of the process air required for operation of conventional vacuum gravity separators at an equivalent feed rate of corn.

A compartment-type separator 25, shown in FIG. 9, comprises a table 26 having disposed across its width a series of compartments 27, each compartment having ends that extend to and open to opposite ends of the table. One side of the table, which abuts one opened end of the compartments, is positioned at an incline with respect to the opposite side. Reciprocating motion directionally across the length of the tables, provided by a drive mechanism 28 connected to table 26, causes the degerminated corn feed inlet stream 31 particles CE (endosperm) and CG (germ) to separate on the basis of density into endosperm and germ fractions so as to form (a) at least one output stream 29 comprising a relatively high concentration of endosperm and (b) at least one output stream 30 comprising a relatively high concentration of germ. A compartment-type separator suitable for the inventive process is available from Buhler Inc. of Minneapolis, Minn.

Typically, the output streams include at least one output stream comprising at least 90% endosperm and the balance germ and at least one output stream comprising at least 90% corn germ and the balance endosperm.

The tray and table separators can be operated to produce two, three or more output streams, as desired. In the embodiment illustrated in FIG. 6, the method results in three discharge streams having the following typical compositions on a weight basis, which depend on the composition of inlet stream A and the efficiency of separation:

(a) an endosperm-rich fraction output stream B, typically containing endosperm in the range of from about 90% to 94%, and more typically about 92%, and the balance being germ;

(b) an intermediate fraction output stream C, typically containing endosperm in the range of from about 57% to 63%, and more typically about 60% endosperm, and the balance being germ; and (c) a germ-rich fraction output stream D, typically containing germ in the range of from about 80–85%, and more typically about 83%, and the balance being endosperm.

On a weight basis, the total flow rate of output stream B, comprising primarily endosperm, typically contains about 52% to about 58% of the total flow rate of the degerminated corn feed stream A and more typically at least about 54% of the feed stream. Typically, on a weight basis, the total flow rate of output stream D, comprising primarily germ, typically accounts for less than 2% of the degerminated corn feed stream, and more typically about 1.7%. The concentration and relative flow rates of the output streams will depend on a number of factors, including the concentration of the inlet (feed) stream, the feed rate to a particular separator, the efficiency of the separator, its manner of operation, the location of the discharge streams relative to the table(s), and the physical characteristics of the particular variety of corn being milled.

In the embodiment shown in FIG. 6, secondary or further processing is employed for several of the streams as indicated. Endosperm-rich fraction output stream B is further processed so as to form at least one even more highly concentrated endosperm fraction stream E containing, on a weight basis, at least about 99% endosperm, and at least one highly concentrated germ fraction stream F containing at least about 99% germ. Stream F may be pressed to extract corn oil. The secondary-processing step can be performed by use of a table separator, a gravity table, or a destoner device, for example. As such equipment is well known to those in the art, the equipment is not disclosed in detail. However, one example of a suitable destoner is the P-8 vacuum destoner manufactured by Forsberg. The endosperm fraction, stream E, is fed to a suitable device, such as a roller mill, where it is ground to the desired particle size to yield a finished grit product (stream G) containing less than 2% fat, preferably about 1.8% fat or less. Such devices are well known to those skilled in the art and are therefore not disclosed in detail here.

In the embodiment shown in FIG. 6, the output stream of intermediate fraction stream C, discharged from the table separator is preferably recycled back to the table separator where it is fed separately from the feed stream of degerminated corn. Preferably, recycled intermediate fraction stream C is further separated so as form at least one endosperm fraction output stream having a concentration of at least 90% endosperm and at least one germ fraction output stream having a concentration of at least 90% germ. Recycled stream C can be recycled to the table separator used to separate feed stream A, to a separate portion or side of that table separator or to another table separator or other type of separator that may be dedicated to processing (separating) stream C.

Output stream D discharged from the table separator and comprising primarily germ at a relatively low flow rate can be processed further, if desired, to achieve a higher degree of separation. The resulting germ can be used for corn oil, for example.

Referring to FIG. 7, there is illustrated another embodiment of the corn milling and separation process of the present invention. The embodiment illustrated in FIG. 7 is somewhat similar to the previously described embodiment of FIG. 6, in that it has the same basic layout. However, the embodiment of FIG. 7 includes additional or secondary processing, including recycle streams. FIG. 7 also sets forth various stream flow rates and concentrations described more particularly with respect to the example.

As illustrated in FIG. 7, the raw corn kernel feed stream is degerminated by the degerminator, producing a degerminated corn feed stream A of 160 cwt per hour (160 hundred weight per hour) which is fed to the primary table separator, the hulls having been removed by any suitable process. The primary table separator produces three output streams, B, C, and D, as previously described with respect to FIG. 6. Stream C, the intermediate output stream of the primary table separator, is recycled to the same or another table separator as shown in FIG. 7. The secondary or regrade table separator also has three output streams, H, I and J.

Stream H, the heavy fraction containing primarily endosperm, is combined with stream B to form stream B' which is then subjected to secondary processing to produce final endosperm-rich stream E, germ-rich stream F and an intermediate recycle stream K. Stream K is recycled to stream B.

Stream I, the intermediate fraction from the re-grade table separator, is combined with stream C (the intermediate stream) from the primary table separator to form stream C+I, which is the inlet stream to the secondary or re-grade table separator.

Stream J, the low-density germ-rich stream from the re-grade table separator, is combined with stream D (the germ-rich stream) from the primary table separator to form germ-rich stream D'.

In accordance with the present invention, a table separator is provided for separating degerminated corn in accordance with the aforedescribed inventive methods. The inventive table separator 10, shown in FIG. 8, comprises a plurality of solid-bottomed trays 12 having a dimpled or indented surface 34, as shown in FIG. 1.

Figure 1:
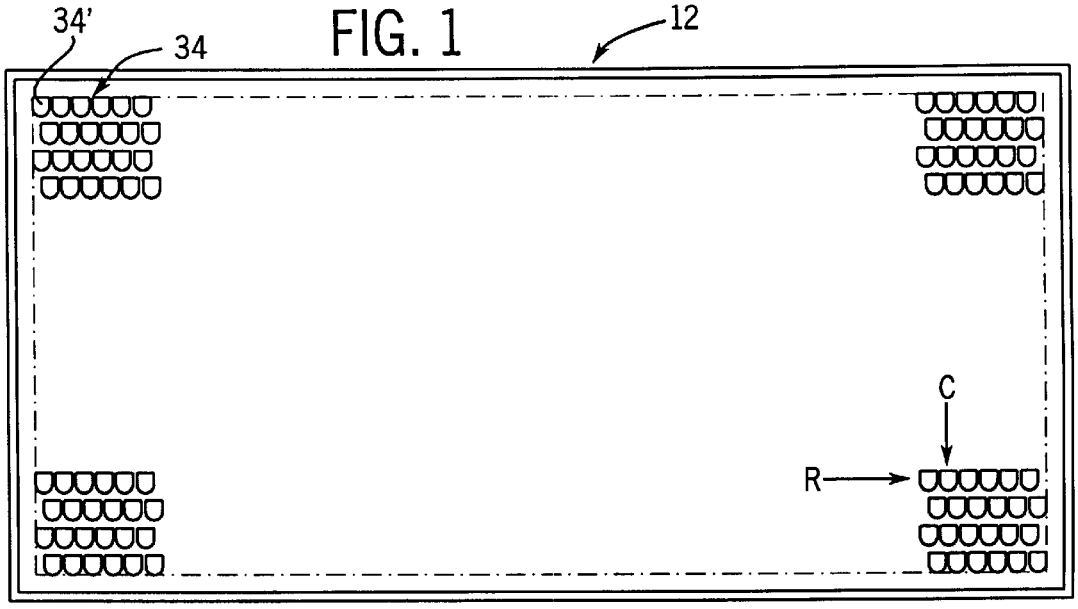
FIG. 1 is a top plan view of an oscillating tray surface, showing a dimpled configuration in the tray surface.
Figure 2:
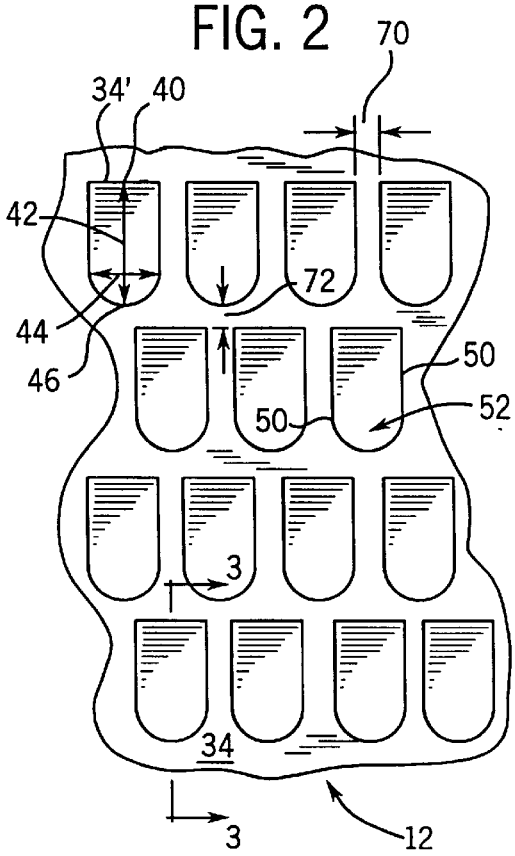
FIG. 2 is a fragmented, enlarged top plan view of the dimpled configuration in the tray surface of FIG. 1.
Figure 3:
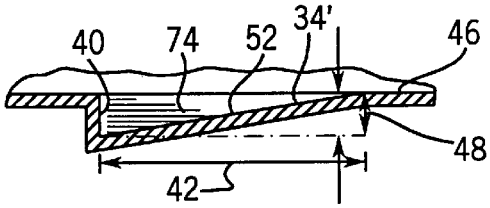
FIG. 3 is an enlarged, cross-sectional view of a dimple shown in FIG. 2, taken along line 3—3 of FIG. 2.
Figure 4:
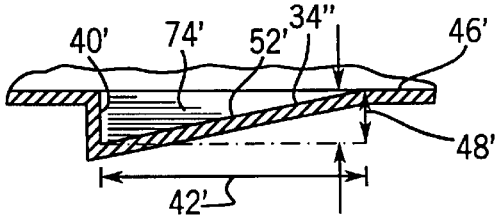
FIG. 4 is an enlarged, cross-sectional view of another dimple embodiment in accordance with the invention.
Figure 5:
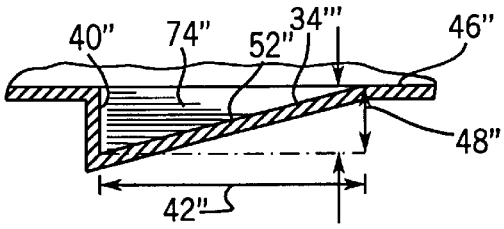
FIG. 5 is an enlarged, cross-sectional view of another dimple embodiment in accordance with the invention.

FIG. 2 shows a portion of dimpled or indented surface 34 of tray 12 of FIG. 1 having a plurality of discrete dimples or indentations 34' disposed thereon, and FIGS. 3–5 illustrate enlarged, cross-sectional views of dimples or depressions in accordance with the invention.

Each dimple 34' is a depression in surface 34 of tray 12. In the illustrated embodiment, dimples 34' are of similar shape and dimensions, extending across the entire surface 34 of tray 12, although for convenience, only dimples 34' in the corners of tray 12 are illustrated in FIG. 1. Typically, and as shown in FIG. 1, dimples 34' are arranged in a uniform array composed of rows R and columns C, in which every other column C is staggered.

Each depression or dimple 34' is defined by a perimeter consisting of a straight end 40, a curved end 46 that is semicircular in shape and opposite from straight end 40, a pair of parallel or generally parallel sides 50 that connect ends 40 and 46. Dimples 34' also have a working depth relative to tray surface 34 that ranges from zero (0) at the curved end 46 to a maximum depth adjacent straight end 40. Generally, planar dimple bottom 52 defines the depth of dimples 34'. Dimple bottom 52 can be configured, as illustrated in FIG. 3, as an inclined ramp extending downwardly from curved end 46 to straight end 40. Adjacent bottom 52, 52' and 52" are a pair of vertical dimple sidewalls 74, 74' and 74", respectively, that are triangularly shaped, as illustrated in FIGS. 3–5.

While the orientation, dimensions and spacings of dimples 34' are important for effective separation of degerminated corn, the depth of the dimples is believed to be particularly important.

Generally, dimples 34' (and dimples 34" and 34'" of FIGS. 4 and 5, respectively) should be similarly oriented and should have a length 42, 42' and 42" of from about 10–14 millimeters and preferably 11 millimeters, a width 44 of from about 5–8 millimeters and preferably about 6 millimeters and a height 48, 48' and 48" of from about 1.5 millimeters to about 6.0 millimeters and preferably about 2.5 to 3.5 millimeters, for degerminated corn in a particle size range of about 3.5 to 6.5 mesh.

Typically, dimples 34', 34" and 34'" have a side-to-side spacing 70 of from about 2 to 4 millimeters and an end-to-end spacing 72 of about 2 to 4 millimeters. In addition, typically dimples 34' are oriented so that the length of dimples 34' is perpendicular to the length of tray 12, as shown in FIG. 1.

EXAMPLE

The following exemplifies a method of corn milling and separation in accordance with the invention for separating degerminated corn into fractions of endosperm and germ.

The process, shown in FIG. 7, would commence with feeding a continuous stream of cleaned kernels of corn, having a moisture content of about 12% to 14%, into a degerminator where the kernels are broken into particles comprising endosperm, germ, and hull. The hull would be substantially removed to yield a degerminated corn feed stream A, at a rate of about 160 cwt per hour, which would then be fed to a Model PS400 table separator manufactured by Satake Engineering Co., Ltd. The degerminated corn would be fed to the inlet of the table separator and onto solid trays of the table separator. The trays, positioned at an angle, would oscillate in a controlled manner to cause separation of the germ from the endosperm. The table separator would yield three output streams, each comprising different ratios of endosperm and germ fractions:

(a) A first output stream B of primarily endosperm fraction, generated at a rate of about 86.4 cwt per hour, would comprise endosperm and germ in a weight ratio of about 92:8. This fraction would account for about 54% of the separated product and would contain about 3% fat.

(b) A second output stream D of primarily germ fraction would comprise at least 99% germ. This fraction, generated at a rate of about 3.2 cwt per hour, would account for about 2% of the separated product.

(c) A third "intermediate" output stream C would comprise endosperm and germ in a weight ratio of about 68:32 and would contain about 10.5% fat. This third output stream would be generated at a rate of about 70.4 cwt per hour and would account for about 44% of the separated, degerminated corn.

Intermediate output stream C would be subjected to further processing on a secondary or re-grade table separator. After being discharged from the primary table separator Model PS400, intermediate output stream C would be combined with stream I, the intermediate fraction from the re-grade table separator. Stream I would be generated from the re-grade table separator at the rate of 22.9 cwt per hour and would comprise endosperm and germ in a ratio of about 54:46. Output stream C would combine with intermediate output stream I to form stream C+I, which is the inlet stream to the secondary or re-grade table separator.

The re-grade table separator would separate inlet stream C+I into three output streams: (a) stream H, an endosperm re-grade fraction discharged at a rate of about 29.9 cwt per hour, which discharge would comprise about 27.6 cwt grit per hour and about 2.3 cwt germ per hour; (b) stream J, a germ re-grade fraction discharged at a rate of about 17.6 cwt per hour, which discharge would comprise about 8.2 cwt grit per hour and 9.4 cwt germ per hour; and (c) stream I, the intermediate, mixed re-grade fraction which is combined with stream C and recycled to the re-grade table separator.

Stream J would be combined with stream D (the germ-rich stream) from the primary table separator to form germ-rich stream D'. Stream D would have a discharge rate of about 20.8 cwt per hour, which would comprise about 8.2 cwt grit per hour and 12.6 cwt germ per hour.

First output stream B of primarily endosperm (grit) fraction would be combined with stream H to form stream B', which would then be further processed to achieve a higher degree of separation and to further reduce the fat content. Stream B', having a rate of about 116.3 cwt per hour, would comprise about 107.4 cwt grit per hour and 8.9 cwt germ per hour. Further separation of stream B' would be done by equipment such as a gravity table, a table separator, or a destoner, for example.

The secondary processing of stream B' would produce three output streams which, on a weight basis, include: (a) stream F, a first output stream comprising at least 99% germ, having a fat content of about 20.5%, and accounting for about 2.1% of stream B'; (b) stream E, a second output stream comprising at least 99% endosperm and accounting for about 84.3% of stream B'; and (c) stream K, a third output stream comprising a mixed fraction and accounting for about 13.6% of stream B'.

Stream K would be recycled back to stream B'. Stream E would be subjected to further processing as desired, such as roller milling in order to reduce particle size and produce the finished grit product G. Finished grit product G would contain less than 2% fat, preferably about 1.8% fat or less, and may have a particle size as desired such that, for example, at least 97% passes through a U.S. sieve, 10 mesh, and 15% at most passes through a U.S. sieve, 15 mesh.

While the invention has been described with respect to certain preferred embodiments, it is to be understood that the invention is capable of numerous changes, modifications and rearrangements without departing from the scope or spirit of the invention as defined in the claims.

We claim:

1. A table separator suitable for separating degerminated corn into at least one endosperm fraction output stream having a predominant concentration of endosperm and at least one germ fraction output stream having a predominant concentration of germ, comprising:

a tray positioned so one end is inclined and said tray is mounted for oscillating movement directionally upward and toward the top of the incline to separate the degerminated corn into said fractions;

a plurality of spaced-apart depressions aligned in a linear array in the surface of the tray, said depressions having one straight end, an opposite curved end and generally parallel sides, the depressions having a generally planar bottom that defines the depth of the depressions, which bottom extends generally downwardly from the curved end to the straight end, the depression depth relative to the surface adjacent the straight end being in the range of about 1.5 millimeters to about 6.0 millimeters and the depth of the depression at the curved end being about zero.

2. The table separator of claim 1 wherein the depression have a maximum working depth of at least about 2.5 millimeters.

3. The table separator of claim 1 wherein the maximum working depth of the depressions is about 3.5 millimeters.

4. The table separator of claim 1 wherein the maximum working depth of the depressions is about 5.0 millimeters.

5. The table separator of claim 1 wherein the depressions have a length in the range of from about 10 to about 14 millimeters.

6. The table separator of claim 1 wherein the depressions have a side-to-side spacing in the range of from about 2 to about 4 millimeters.

7. The table separator of claim 1 wherein the depressions have an end-to-end spacing in the range of from about 2 to about 4 millimeters.

8. The table separator of claim 1 wherein the depressions have a side-to-side spacing in the range of from about 2 to about 4 millimeters and an end-to-end spacing in the range of from about 2 to about 4 millimeters.

9. The table separator of claim 1 wherein the depressions are arrayed in rows and staggered columns with adjacent rows being staggered in a lengthwise direction.

10. A tray for a table separator suitable for separating degerminated corn in a particle size range of about 3.5 to 6.5 mesh into endosperm and grit fractions comprising:

a tray having a generally flat surface with a plurality of spaced-apart depressions in a linear array in the surface of the tray, said depressions having a surface perimeter defining a straight end, an opposite curved end and generally parallel sides, the depressions having a generally planar bottom that defines the depth of the depressions, which bottom extends generally downwardly from the curved end to the straight end, the depression depth relative to the surface adjacent the straight end, being in the range of about 1.5 to 6.0 millimeters and the depth of the depression at the curved end being about zero.

11. The tray of claim 10 wherein the depression have a maximum working depth of at least about 2.5 millimeters.

12. The tray of claim 11 wherein the maximum working depth of the depression is about 3.5 millimeters.

13. The tray of claim 12 wherein the depressions have a length in the range of from about 10 to about 14 millimeters.

14. The tray of claim 10 wherein the depressions have a side-to-side spacing in the range of from about 2 to about 4 millimeters.

15. The tray of claim 10 wherein the depressions have an end-to-end spacing in the range of from about 2 to about 4 millimeters.

16. The tray of claim 10 wherein the depressions have a side-to-side spacing in the range of from about 2 to about 4 millimeters and an end-to-end spacing in the range of from about 2 to about 4 millimeters.

17. The tray of claim 10 wherein the depressions are arrayed in rows and staggered columns with adjacent rows being staggered in a lengthwise direction.

* * * * *